US012467195B2

(12) United States Patent
Zheng et al.

(10) Patent No.: US 12,467,195 B2
(45) Date of Patent: Nov. 11, 2025

(54) STEAM BRUSH WITH CLAMPING AND IRONING STRUCTURE

(71) Applicant: Tsann Kuen (Zhangzhou) Enterprise Co., Ltd., Zhangzhou (CN)

(72) Inventors: Zhenxing Zheng, Zhangzhou (CN); Ronghuang Chen, Zhangzhou (CN); Longhai Zhou, Zhangzhou (CN)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 0 days.

(21) Appl. No.: 18/822,669

(22) Filed: Sep. 3, 2024

(65) Prior Publication Data

US 2025/0075421 A1 Mar. 6, 2025

(30) Foreign Application Priority Data

Sep. 6, 2023 (CN) ..... 202322417956.9
Nov. 3, 2023 (CN) ..... 202311462041.8
Feb. 5, 2024 (CN) ..... 202410166704.X

(51) Int. Cl.
*D06F 71/36* (2006.01)
*D06F 71/02* (2006.01)
*D06F 71/34* (2006.01)

(52) U.S. Cl.
CPC ..... *D06F 71/36* (2013.01); *D06F 71/02* (2013.01); *D06F 71/34* (2013.01)

(58) Field of Classification Search
CPC ..... D06F 75/30; D06F 71/02; D06F 71/34; D06F 71/36
See application file for complete search history.

(56) References Cited

U.S. PATENT DOCUMENTS 2,458,530 A * 1/1949 Resnick ..... D06F 75/30 15/105
7,188,442 B2 * 3/2007 Fernandez ..... D06F 75/40 38/81
11,168,439 B1 * 11/2021 Toll ..... D06F 75/34
2016/0340824 A1 * 11/2016 Burke ..... D06F 75/40

FOREIGN PATENT DOCUMENTS

CN 201162146 Y 12/2008
CN 212582250 U * 2/2021

* cited by examiner

*Primary Examiner* — Nathan E Durham
(74) *Attorney, Agent, or Firm* — Cooper Legal Group, LLC

(57) ABSTRACT

The disclosure provides a steam brush with a clamping and ironing structure, including a steam brush body and a plate clamp. A material of the plate clamp is a thermally conductive material, and the plate clamp is a frame structure with a hollowed middle part. The plate clamp is hingedly connected to the steam brush body and forms a clamping and ironing structure with an ironing surface. When ironing a garment, the plate clamp can obtain heat from an ironing panel, thereby achieving a better ironing effect.

13 Claims, 8 Drawing Sheets

STEAM BRUSH WITH CLAMPING AND IRONING STRUCTURE

CROSS-REFERENCE TO RELATED APPLICATIONS

This application claims priority to Chinese Patent Application 202410166704.X, filed on Feb. 5, 2024, Chinese Patent Application 202311462041.8, filed on Nov. 3, 2023, and Chinese Patent Application 202322417956.9, filed on Sep. 6, 2023, which are incorporated herein by reference.

TECHNICAL FIELD

The disclosure relates to the field of steaming ironing machines, and in particular to a steam brush with a clamping and ironing structure.

BACKGROUND

Steam ironing of garments has the characteristics of high ironing speed, high ironing efficiency, and no influence on the surface and internal texture of the garments. Therefore, steaming ironing machines are widely used.

Publication No. CN201162146Y discloses a steam jet for a hanging ironing machine, which realizes a clamping and ironing structure by arranging a garment clamping board opposite to the ironing and brushing board. The garment clamping board is arranged to clamp the garment to one side of the ironing and brushing board, such that the garment hanging on a hanger can be ironed when there is no support. The garment clamping board (plate clamp) is mostly made of a high-temperature-resistant plastic material. However, this clamping and ironing device does not have a more significant ironing effect.

SUMMARY

Therefore, in order to alleviate the above problems and achieve a better ironing effect, the disclosure provides a steam brush with a clamping and ironing structure.

In order to achieve the above objective, the disclosure provides the following technical solution:

A steam brush with a clamping and ironing structure includes a steam brush body and a plate clamp. The steam brush body has an ironing surface and steam outlets provided on the ironing surface. The plate clamp is hingedly connected to the steam brush body and forms the clamping and ironing structure with the ironing surface. A material of the plate clamp is a metal material. The plate clamp is a frame structure with a hollowed middle part.

Further, the metal material is aluminum or aluminum alloy or stainless steel or iron or powder metallurgy.

Further, the steam brush body is provided with a driving portion and an elastic return member. The driving portion acts on the plate clamp to drive the plate clamp to open, and the elastic return member acts on the plate clamp to drive the plate clamp to close.

Further, the plate clamp is provided with a connecting arm. The connecting arm is inserted into the steam brush body via the ironing surface, and the connecting arm is hingedly connected to the steam brush body by means of a hinge shaft, thereby realizing a hinged connection of the plate clamp. Both the driving portion and the elastic return member act on the connecting arm.

Further, the elastic return member is a double torsion spring, and torsion spring sections at two ends of the double torsion spring are respectively sleeved on two ends of the hinge shaft. A middle arm and end arms of the double torsion spring respectively abut against the steam brush body and the connecting arm to drive the plate clamp to close.

Further, the driving portion is a press assembly, and a press of the press assembly drives the connecting arm to swing with the hinge shaft as a pivot, thereby driving the plate clamp to open.

Further, the steam brush body further has a handle to be held by a hand, and the press assembly includes a transmission link and a button. The button is arranged on the handle of the steam brush body. A first end of the transmission link is hingedly connected with the button, and a second end of the transmission link is hingedly connected to the connecting arm of the plate clamp. The button, when pressed by external force, drives the connecting arm to swing with the hinge shaft as the pivot by means of the transmission link.

Further, the button is hingedly connected to the handle. A first end of the button is hingedly connected with the transmission link, and a second end of the button serves as a press end. In operation, a finger exerts force to press the press end of the button, the press end of the button swings upward, and the first end of the button swings downward, thereby driving the transmission link to move downward.

Further, the steam brush body includes an electric heating plate, an insulation base, and a heat insulation shield. A bottom surface of the electric heating plate is the ironing surface. The steam outlets are provided on the electric heating plate. The electric heating plate is provided with a steam jet in communication with the steam outlets. The insulation base is a heat insulation base board. The insulation base covers the electric heating plate and is provided with an avoidance window for avoiding the steam jet. The heat insulation shield covers the steam jet and is fixed on the insulation base.

Further, an outer edge of the ironing surface of the steam brush body is depressed inward to form a depression, and the depression and the ironing surface are connected through an inclined transition surface. When in a closed position, the plate clamp is accommodated in the depression, and an inner wall of the plate clamp is an inclined inner wall corresponding to the inclined transition surface.

Further, the hollowed middle part of the plate clamp accounts for at least 50% of a total area formed by the plate clamp.

Further, when the plate clamp is in a closed position, the ironing surface is located in the hollowed middle part of the plate clamp.

Further, when the plate clamp is in the closed position, the ironing surface is flush with or protrudes from a bottom of the plate clamp.

Further, when the plate clamp is in the closed position, the ironing surface protrudes from the bottom of the plate clamp by a height H of 0.4 mm-1 mm.

A steaming ironing machine includes at least the above steam brush with a clamping and ironing structure.

The technical solution provided by the disclosure has the following beneficial effects:

1. By setting the material of the plate clamp to be the thermally conductive material and preferably the metal material with good thermal conduction effect, when ironing a garment, the plate clamp can obtain heat from an ironing panel (i.e., the component forming the ironing surface), such that both sides of the garment clamped between the ironing panel and the plate clamp can be ironed, thereby achieving a better ironing effect.

2. By setting the plate clamp to be a frame structure with a hollowed middle part, when using the clamping and ironing function (i.e., when the plate clamp is in the closed position, the garment is clamped and ironed between the plate clamp and the steam brush body), the state in which the garment has been clamped and ironed can be seen directly.

DESCRIPTION OF EMBODIMENTS

Figure 1:
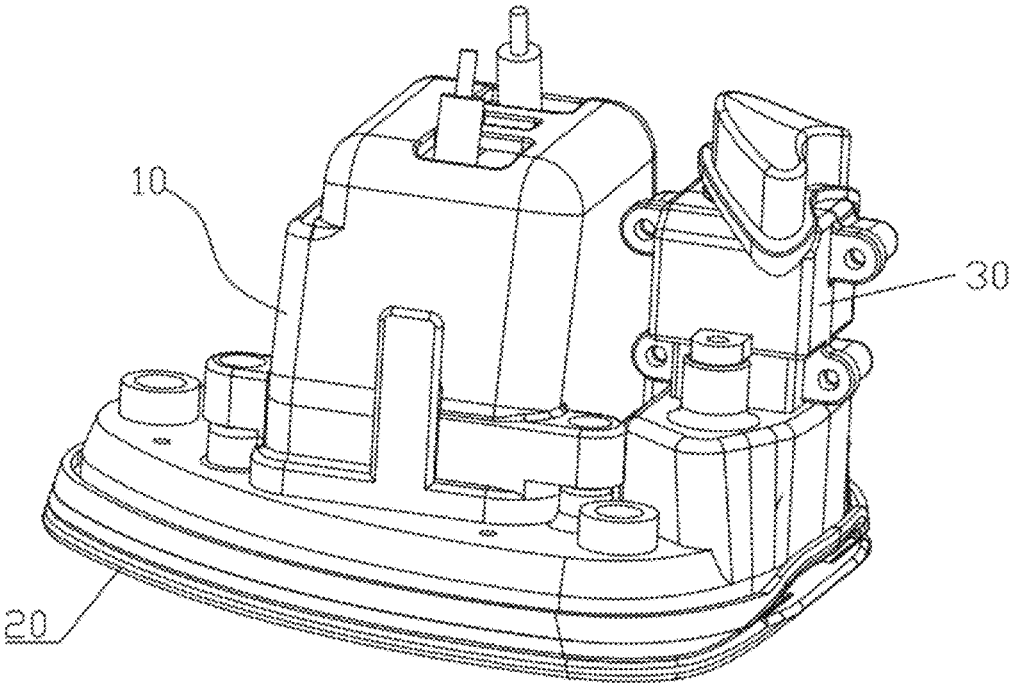
FIG. 1 is a schematic view I showing the appearance of a steam brush with a clamping and ironing structure in an example.
Figure 2:
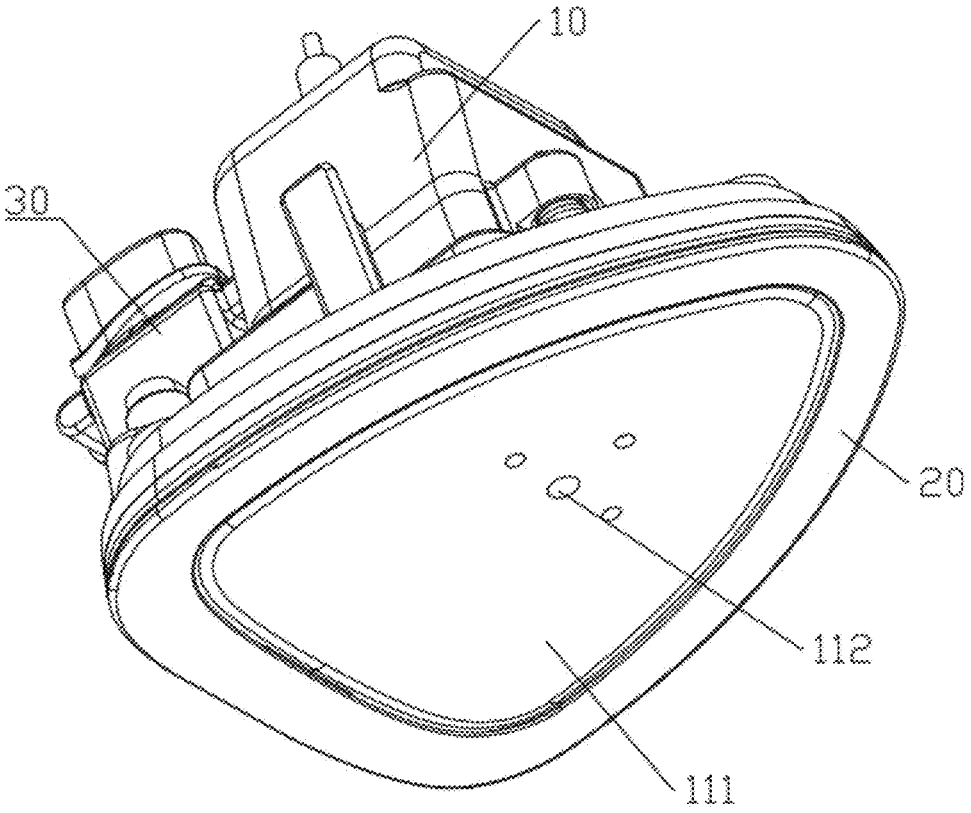
FIG. 2 is a schematic view II showing the appearance of the steam brush with a clamping and ironing structure in an example.

To further illustrate the examples, the accompanying drawings are provided in the disclosure. These accompanying drawings are a part of the contents disclosed in the disclosure that are mainly used to illustrate the examples, and can be used in conjunction with the related descriptions in the specification to explain the operation principle of the examples. With reference to these contents, those of ordinary skill in the art should be able to understand other possible embodiments and advantages of the disclosure. Components in the drawings are not drawn to scale, and like component symbols are usually used to represent like components.

The disclosure will be further described in conjunction with the accompanying drawings and specific embodiments.

Example I

Referring to FIG. 1 to FIG. 5, this example provides a steam brush with a clamping and ironing structure, including a steam brush body 10 and a plate clamp 20. The steam brush body 10 has an ironing surface 111 and steam outlets 112 provided on the ironing surface 111. A material of the plate clamp 20 is a metal material. The plate clamp 20 is hingedly connected to the steam brush body 10 and forms the clamping and ironing structure with the ironing surface 111.

The plate clamp 20 opens and closes to clamp a garment, so that the garment can be clamped and ironed. Moreover, by setting the material of the plate clamp 20 to be the metal material with good thermal conduction effect, when ironing the garment, the plate clamp 20 can obtain heat from an ironing panel (i.e., the component forming the ironing surface 111, which is an electric heating plate 11 described below), such that both sides of the garment clamped between the ironing panel and the plate clamp 20 can be ironed, thereby achieving a better ironing effect.

Specifically, the plate clamp 20 made of the metal material may be the plate clamp 20 made of an elemental metal material, such as copper, aluminum, iron or steel, or the plate clamp 20 made of a metal alloy material, such as aluminum alloy, copper alloy or powder metallurgy.

Preferably, in this example, the plate clamp 20 is made of an aluminum alloy material with an anodized surface, or a ceramic-coated aluminum alloy material. By using the aluminum alloy material on the premise of satisfying the thermal conductivity, the weight can be reduced, and moreover, the anodization of the surface or the arrangement of the ceramic coating can improve the wear resistance of the aluminum alloy material and improve the smoothness.

The steam brush body 10 is provided with a driving portion 30 and an elastic return member 40. The driving portion 30 acts on the plate clamp 20 to drive the plate clamp 20 to open. The elastic return member 40 acts on the plate clamp 20 to drive the plate clamp 20 to close. The user may drive the plate clamp 20 to open by means of the driving portion 30. Then, when the user releases the driving portion 30, the plate clamp 20 loses the driving of the driving portion 30 and closes again under the action of the elastic return member 40, such that the garment is clamped.

Specifically, the plate clamp 20 is provided with a connecting arm 21. In this example, the connecting arm 21 is fixed to the plate clamp 20 by means of assembly. The connecting arm 21 is inserted into the steam brush body 10 via the ironing surface 111, and the connecting arm 21 is hingedly connected to the steam brush body 10 by means of a hinge shaft 22, thereby realizing a hinged connection of the plate clamp 20. Both the driving portion 30 and the elastic return member 40 act on the connecting arm 21. With this arrangement, the hinged connection of the plate clamp 20, the cooperation with the elastic return member 40 and the cooperation structure with the driving portion 30 are all integrated in the steam brush body 10, thereby realizing hidden design and making the appearance more concise and beautiful.

Specifically, in this example, the elastic return member 40 is a double torsion spring 41, and torsion spring sections at two ends of the double torsion spring 41 are respectively sleeved on two ends of the hinge shaft 22. A middle arm 411 and end arms 412 of the double torsion spring 41 respectively abut against the steam brush body 10 and the connecting arm 21 to drive the plate clamp 20 to close. When the plate clamp 20 opens, the double torsion spring 41 is compressed to accumulate energy. After external force is removed from the plate clamp 20, the double torsion spring 41 returns to its original shape and drives the plate clamp 20 to close. With the structure of the double torsion spring 41, the stress is uniform, and the connecting structure is simple. Of course, in other examples, the elastic return member 40 may also be replaced with another elastic member capable of returning to its original shape because of elasticity.

The driving portion 30 is a press assembly, and a press of the press assembly drives the connecting arm 21 to swing with the hinge shaft 22 as a pivot, thereby driving the plate clamp 20 to open. The driving by means of pressing is simple to operate.

Specifically, the press assembly includes a press member 34, a slider 31, and a slider housing 32. The slider housing 32 is fixed to the steam brush body 10. Specifically, the slider housing 32 is formed by splicing a left half housing and a right half housing. The slider 31 is slidable up and down and is assembled on the slider housing 32. A bottom of the slider 31 is provided with an inclined elongated hole 311. The connecting arm 21 is assembled with a slider rotating shaft 23. The slider rotating shaft 23 runs through the inclined elongated hole 311. The press member 34 is connected to a top of the slider 31. The downward press of the press member 34 drives the slider 31 to move downward, thereby driving the connecting arm 21 to swing with the hinge shaft 22 as the pivot.

Further, the press assembly further includes a spring 35 and a spring top cap 33. The spring top cap 33 is fixed to the top of slider 31, and the press member 34 is assembled on the spring top cap 33 so as to be connected to the top of the slider 31. The spring 35 acts on the spring top cap 33 to drive the slider 31 connected thereto, the spring top cap 33 and the press member 34 to move to their original positions, getting ready for the next press. The spring 35 and the spring top cap 33 are adopted to allow the slider 31 and the press member 34 to return to their original positions more stably. Of course, in other examples, the spring 35 and the spring top cap 33 may not be adopted, and the press assembly may return under the driving of the elastic return member 40.

Specifically, the slider housing 32 and the spring top cap 33 are made of a heat insulation material that can isolate heat transferred from the plate clamp 20.

The steam brush body 10 includes an electric heating plate 11, an insulation base 13, and a heat insulation shield 14. A bottom surface of the electric heating plate 11 is the ironing surface 111, that is the electric heating plate 11 is the above ironing panel. The steam outlets 112 are provided on the electric heating plate 11. The electric heating plate 11 is provided with a steam jet 12 in communication with the steam outlets 112. The insulation base 13 is a heat insulation base board, which, for example, may be made of a heat-resistant plastic material. The insulation base 13 covers the electric heating plate 11 and is provided with an avoidance window 131 for avoiding the steam jet 12. The slider housing 32 of the press assembly is assembled on the insulation base 13. The heat insulation shield 14 covers the steam jet 12 and is fixed on the insulation base 13, which performs a good heat insulation function. By adopting the above structure, the steam brush body 10 is reasonable in structural layout. Of course, in other examples, the structure of the steam brush body 10 is not limited thereto.

An outer edge of the ironing surface 111 of the steam brush body 10 is depressed inward to form a depression 113. Specifically, the ironing surface 111 of the steam brush body 10 is similar to a triangular plane, and the depression 113 is similar to a closed triangular structure. The depression 113 and the ironing surface 111 are connected through an inclined transition surface 114. The plate clamp 20 is a frame structure with a hollowed middle part, which is specifically a triangular frame structure. When in a closed position, the plate clamp 20 is accommodated in the depression 113, and the ironing surface 111 is located in the hollowed middle part of the plate clamp 20, i.e., the steam outlets 112 arranged on the ironing surface 111 also directly correspond to the hollowed middle part of the plate clamp 20. After the garment is clamped, the garment can fit tightly on the ironing surface 111. An inner wall of the plate clamp 20 is an inclined inner wall 201 corresponding to the inclined transition surface 114. With this arrangement, the inclined transition surface 114 and the inclined inner wall 201 form an inclined channel, through which the garment can slide smoothly when ironing the garment. Besides, after the plate clamp 20 closes, a surface of a steam panel is so smooth that it can iron the garment like an ordinary steam brush.

According to the solution disclosed in this application, by setting the plate clamp 20 to be a frame structure with a hollowed middle part, when using the clamping and ironing function (i.e., when the plate clamp 20 is in the closed position, the garment is clamped and ironed between the plate clamp 20 and the steam brush body 10), the state in which the garment has been clamped and ironed can be seen directly. For example, if the garment is not flat enough, it can be adjusted in time. Whether wrinkles on the garment have been removed can be confirmed directly, so that whether ironing should be continued can be determined in time.

Moreover, the ironing surface 111 is located in the hollowed middle part of the plate clamp 20. Steam ejected from the steam outlets 112 has strong penetrating power because it is not blocked by the plate clamp 20, thus achieving a better ironing effect, and moreover, the steam will not stay to wet the garment.

The ironing surface 111 is located in the hollowed middle part of the 20. During an ordinary ironing operation (in which the garment is placed on a support platform, and the steam brush body 10 is placed on the garment such that the ironing surface 111 directly contacts the garment to iron), the plate clamp 20 is closed, the steam outlets 112 can be exposed from the hollowed middle part, and steam from the steam outlet 112 is directly ejected onto the garment. Besides, when ironing the garment, since the ironing surface 111 can be exposed from the hollowed middle part of the plate clamp 20, heat can be directly transferred to the garment. Thereby, the heat conduction effect will not be affected by the presence of the plate clamp 20, and the temperature at which the garment is ironed can be kept at a high level.

Figure 4:
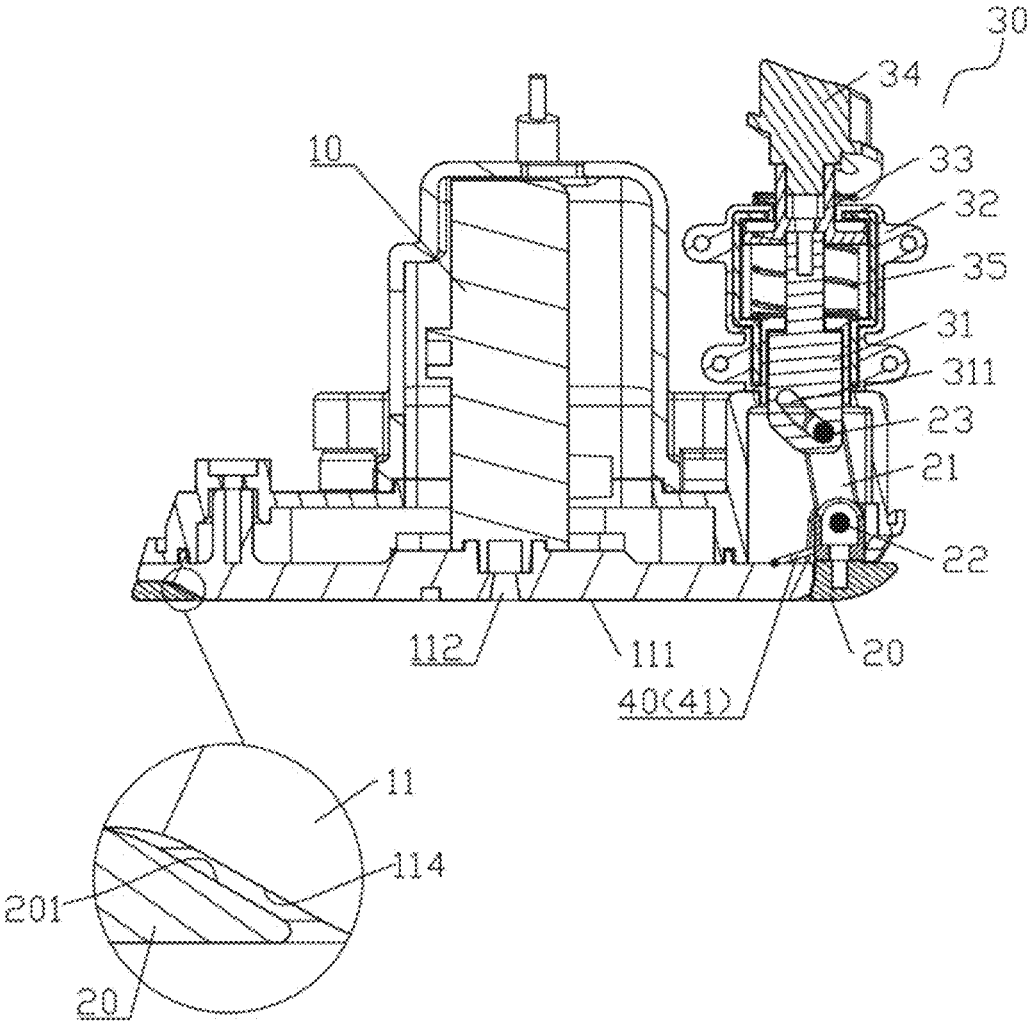
FIG. 4 is a sectional view of the steam brush with a clamping and ironing structure in an example.
Figure 5:
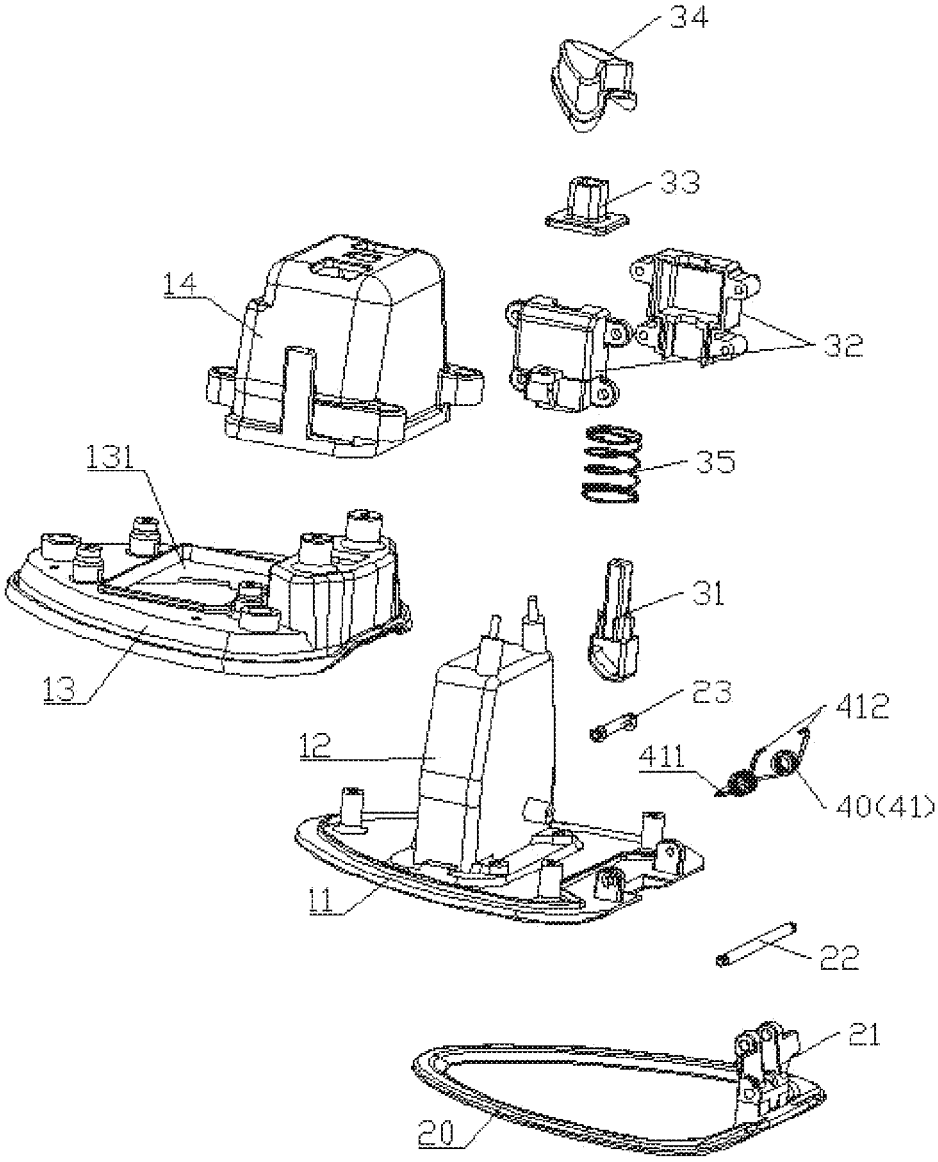
FIG. 5 is a schematic structural exploded view of the steam brush with a clamping and ironing structure in an example.
Figure 9:
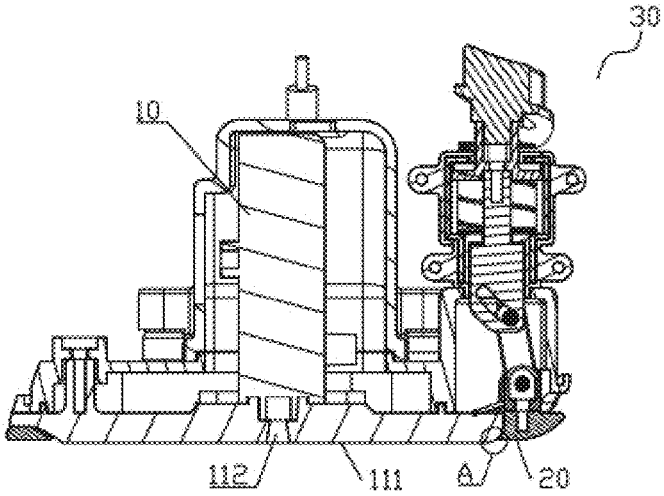
FIG. 9 is a sectional view of the steam brush with a clamping and ironing structure in a clamped state in yet another example.
Figure 10:
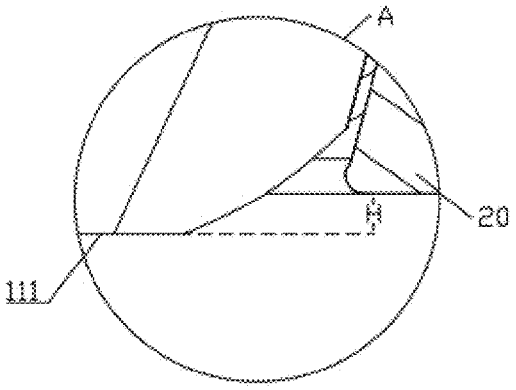
FIG. 10 is a schematic enlarged view of A in FIG. 9.

Moreover, due to the arrangement of the depression 113, when the plate clamp 20 is in the closed position, the ironing surface 111 of the steam brush body 10 can be flush with the bottom of the plate clamp 20 (as shown in FIG. 4) or protrude from the bottom of the plate clamp 20 (as shown in FIG. 9 and FIG. 10), which allows the ironing surface 111 to better contact and iron the garment in the ordinary ironing operation.

With the cooperation between the depression 113 and the plate clamp 20, the garment can slide smoothly during the clamping and ironing process. Besides, due to the presence of the depression 113, the garment can be subjected to a certain resistance when being pulled away from the ironing panel, which makes the garment tighter, thus achieving a better ironing effect.

Figure 6:
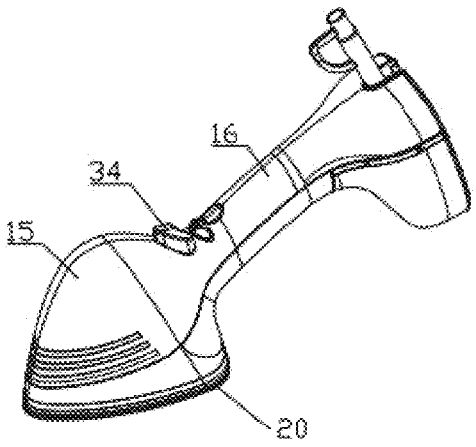
FIG. 6 is a schematic view showing the appearance of the steam brush with a clamping and ironing structure after assembly of a housing in an example.

Referring to FIG. 6, the steam brush body 10 includes a housing 15. Specifically, the housing 15 has a handle 16. The housing 15 covers the insulation base 13, the heat insulation shield 14, and other structures. The electric heating plate 11 is exposed outside the bottom of the housing 15 to cooperate with the plate clamp 20. The press member 34 is arranged at a top of the housing 15 away from the plate clamp 20. In operation, the operator presses the press member 34 down from the top of the housing 15, thereby driving the plate clamp 20 to open.

This example further provides a steaming ironing machine, including at least the steam brush with a clamping and ironing structure described above.

Example II

This example provides a steam brush with a clamping and ironing structure. The structures of the steam brush body 10, the plate clamp 20 and the elastic return member 40 of the steam brush are the same as those in Example I, and the driving portion 30 in this example is also the press assembly. A press of the press assembly drives the connecting arm 21 to swing with the hinge shaft 22 as the pivot, thereby driving the plate clamp 20 to open.

Figure 7:
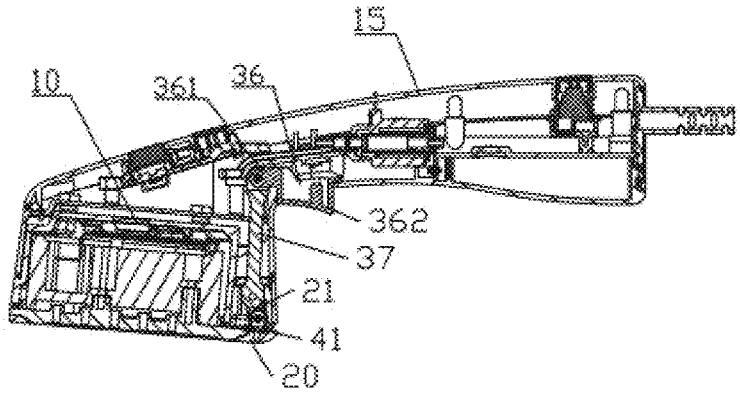
FIG. 7 is a sectional view of the steam brush with a clamping and ironing structure in a clamped state in another example.
Figure 8:
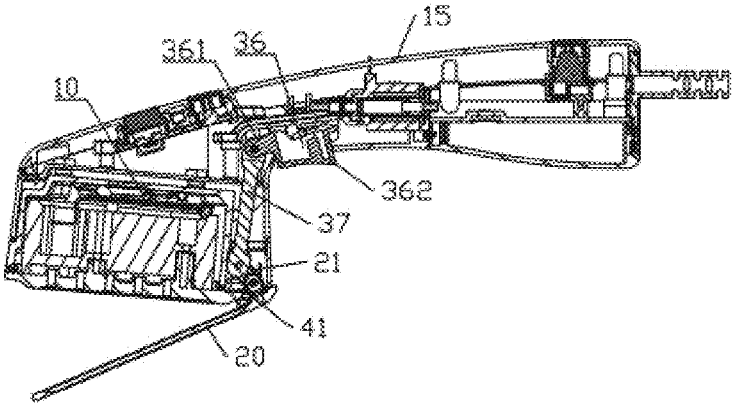
FIG. 8 is a sectional view of the steam brush with a clamping and ironing structure in an open state in another example.

The steam brush with a clamping and ironing structure provided in this example is different from Example I in that:

As shown in FIG. 7 and FIG. 8, the press assembly includes a transmission link 37 and a button 36. The button 36 is arranged on the handle 16 of the steam brush body 10, specifically on a bottom of the handle 16. A first end of the transmission link 37 is hingedly connected with the button 36, and a second end of the transmission link 37 is hingedly connected to the connecting arm 21 of the plate clamp 20. The button 36, when pressed by external force, drives the connecting arm 21 to swing with the hinge shaft 22 as the pivot by means of the transmission link 37.

When using, in the state shown in FIG. 7, the operator holds the handle 16 with one hand, such that a finger can easily contact the button 36 on the handle 16. When the plate clamp 20 needs to be opened, the finger exerts force to press the button 36, the press of the button 36 drives the transmission link 37 to move downward so as to drive the connecting arm 21 to swing with the hinge shaft 22 as the pivot, such that the plate clamp 20 opens, as shown in FIG. 8. After the press exerted on the button 36 is removed, the double torsion spring 41 returns to its original shape and drives the plate clamp 20 to close. While the plate clamp 20 is closing, the transmission link 37 and the button 36 are synchronously driven by the connecting arm 21 to return to the state shown in FIG. 7, getting ready for the next operation.

Further, the button 36 is hingedly connected to the handle 16. A first end 361 of the button 36 is hingedly connected with the transmission link 37, and a second end 362 serves as a press end. In operation, the finger exerts force to press the press end of the button 36, the press end of the button 36 swings upward, and the first end 361 of the button 36 swings downward, thereby driving the transmission link 37 to move downward.

The press assembly adopting the above structure is simple in structure and convenient to operate. That is, the user can hold the handle 16 with one hand and easily control the plate clamp 20 to open or close by pressing the button 36.

This example further provides a steaming ironing machine, including at least the steam brush with a clamping and ironing structure described above.

Example III

This example provides a steam brush with a clamping and ironing structure, which has substantially the same structure as the steam brush with a clamping and ironing structure provided in Example I or Example II, except that: in Example I and Example II, the plate clamp 20 is made of a metal thermally conductive material, but in this example, the plate clamp 20 is made of a nonmetal thermally conductive material, such as plastic and graphite with good high-temperature resistance and thermal conductivity. The steam brush in this structure can also iron both sides of the garment. Compared with the metal thermally conductive material, the use of the nonmetal thermally conductive material may have the problems of poor hardness or high cost. The plate clamp is preferably made of a metal thermally conductive material.

Example IV

Figure 3:
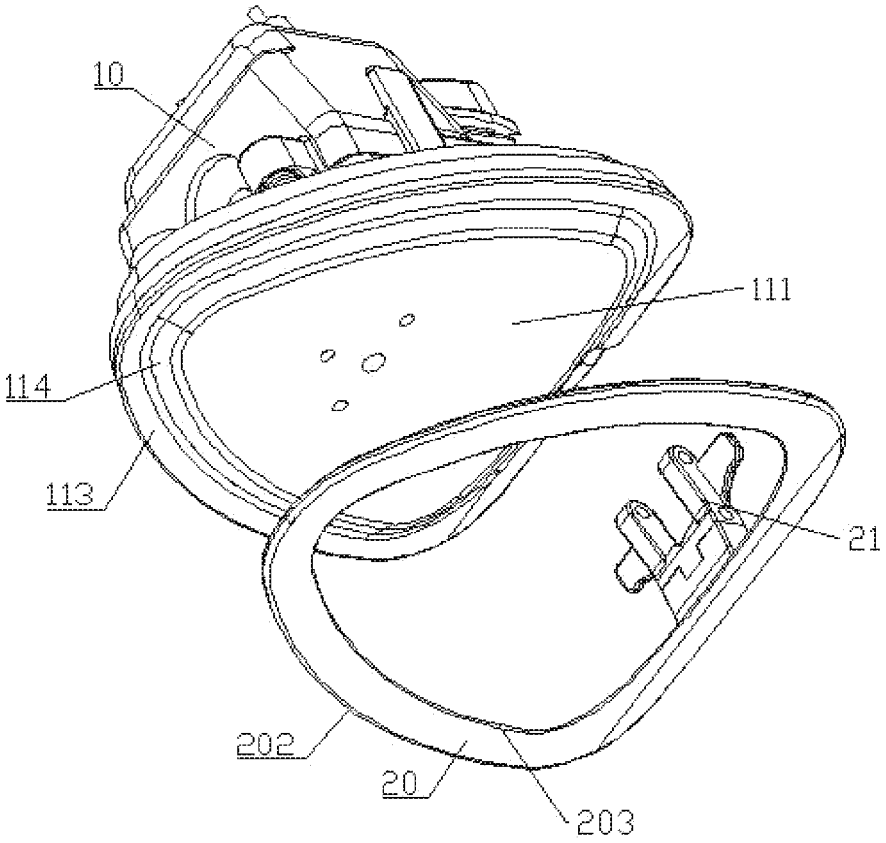
FIG. 3 is a schematic partial structural exploded view of the steam brush with a clamping and ironing structure in an example.

This example provides a steam brush with a clamping and ironing structure, which has substantially the same structure as the steam brush with a clamping and ironing structure provided in Example I. Moreover, on the basis of Example I, the plate clamp 20 with a hollowed middle part is set such that the hollowed middle part of the plate clamp 20 accounts for at least 50% of a total area formed by the plate clamp 20, which can fully ensure the transfer of heat. As shown in FIG. 3, the hollowed middle part of the plate clamp 20 accounts for about 70%-80%, which can provide a larger space to expose the ironing surface 111, thereby ensuring the ironing effect.

Specifically, as shown in FIG. 3, the area of the hollowed middle part of the plate clamp 20 may be understood as the area formed by an inner ring 203 of the plate clamp 20, and the total area formed by the plate clamp 20 may be understood as the area formed by an outer ring 202 of the plate clamp 20, which includes the area of the hollowed middle part of the plate clamp 20.

Example V

This example provides a steam brush with a clamping and ironing structure, which has substantially the same structure as the steam brush with a clamping and ironing structure provided in Example I, except that: as shown in FIG. 9 and FIG. 10, when the plate clamp 20 is in the closed position, the ironing surface 111 protrudes from the bottom of the plate clamp 20. Preferably, the ironing surface 111 protrudes from the bottom of the plate clamp 20 by a height H of 0.4 mm-1 mm. In this example, the height H is 0.5 mm. With this arrangement, it is ensured that the ironing surface 111 can completely contact the garment (especially when in the ordinary ironing operation), which makes the ironing temperature higher and more uniform.

Although the disclosure has been specifically shown and described in connection with the preferred embodiments, it should be understood by those skilled in the art that various changes in form and details can be made without departing from the spirit and scope of the disclosure as defined by the appended claims, and shall all fall within the protection scope of the disclosure.

The invention claimed is:

1. A steam brush with a clamping and ironing structure, comprising:

a steam brush body and a plate clamp, the steam brush body having an ironing surface and steam outlets provided on the ironing surface, wherein the plate clamp is hingedly connected to the steam brush body and forms the clamping and ironing structure with the ironing surface, a material of the plate clamp is a thermally conductive material, and the plate clamp is a frame structure with a hollowed middle part;

wherein the thermally conductive material is a metal material;

wherein the steam brush body is provided with a driving portion and an elastic return member, the driving portion acts on the plate clamp to drive the plate clamp to open, and the elastic return member acts on the plate clamp to drive the plate clamp to close; and wherein the plate clamp is provided with a connecting arm, the connecting arm is inserted into the steam brush body via the ironing surface, the connecting arm is hingedly connected to the steam brush body by means of a hinge shaft, thereby realizing a hinged connection of the plate clamp, and both the driving portion and the elastic return member act on the connecting arm.

2. The steam brush with a clamping and ironing structure according to claim 1, wherein the metal material is aluminum or aluminum alloy or stainless steel or iron or powder metallurgy.

3. The steam brush with a clamping and ironing structure according to claim 1, wherein the elastic return member is a double torsion spring, torsion spring sections at two ends of the double torsion spring are respectively sleeved on two ends of the hinge shaft, and a middle arm and end arms of the double torsion spring respectively abut against the steam brush body and the connecting arm to drive the plate clamp to close.

4. The steam brush with a clamping and ironing structure according to claim 1, wherein the driving portion is a press assembly, and a press of the press assembly drives the connecting arm to swing with the hinge shaft as a pivot, thereby driving the plate clamp to open.

5. The steam brush with a clamping and ironing structure according to claim 4, wherein the steam brush body further has a handle to be held by a hand, the press assembly comprises a transmission link and a button, the button is arranged on the handle of the steam brush body, a first end of the transmission link is hingedly connected with the button, a second end of the transmission link is hingedly connected to the connecting arm of the plate clamp, and the button, when pressed by external force, drives the connecting arm to swing with the hinge shaft as the pivot by means of the transmission link.

6. The steam brush with a clamping and ironing structure according to claim 5, wherein the button is hingedly connected to the handle, a first end of the button is hingedly connected with the transmission link, a second end of the button serves as a press end, and in operation, a finger exerts force to press the press end of the button, the press end of the button swings upward, and the first end of the button swings downward, thereby driving the transmission link to move downward.

7. The steam brush with a clamping and ironing structure according to claim 1, wherein the steam brush body comprises an electric heating plate, an insulation base and a heat insulation shield, a bottom surface of the electric heating plate is the ironing surface, the steam outlets are provided on the electric heating plate, the electric heating plate is provided with a steam jet in communication with the steam outlets, the insulation base is a heat insulation base board, the insulation base covers the electric heating plate and is provided with an avoidance window for avoiding the steam jet, and the heat insulation shield covers the steam jet and is fixed on the insulation base.

8. The steam brush with a clamping and ironing structure according to claim 1, wherein an outer edge of the ironing surface of the steam brush body is depressed inward to form a depression, the depression and the ironing surface are connected through an inclined transition surface, and when in a closed position, the plate clamp is accommodated in the depression and an inner wall of the plate clamp is an inclined inner wall corresponding to the inclined transition surface.

9. The steam brush with a clamping and ironing structure according to claim 1, wherein the hollowed middle part of the plate clamp accounts for at least 50% of a total area formed by the plate clamp.

10. The steam brush with a clamping and ironing structure according to claim 1, wherein when the plate clamp is in a closed position, the ironing surface is located in the hollowed middle part of the plate clamp.

11. The steam brush with a clamping and ironing structure according to claim 10, wherein when the plate clamp is in the closed position, the ironing surface is flush with or protrudes from a bottom of the plate clamp.

12. The steam brush with a clamping and ironing structure according to claim 11, wherein when the plate clamp is in the closed position, the ironing surface protrudes from the bottom of the plate clamp by a height ranging from 0.4 mm to 1 mm.

13. A steam brush with a clamping and ironing structure, comprising:

a steam brush body and a plate clamp, the steam brush body having an ironing surface and steam outlets provided on the ironing surface, wherein the plate clamp is hingedly connected to the steam brush body and forms the clamping and ironing structure with the ironing surface, a material of the plate clamp is a thermally conductive material, and the plate clamp is a frame structure with a hollowed middle part; and wherein the thermally conductive material is a metal material;

wherein an outer edge of the ironing surface of the steam brush body is depressed inward to form a depression, the depression and the ironing surface are connected through an inclined transition surface, and when in a closed position, the plate clamp is accommodated in the depression and an inner wall of the plate clamp is an inclined inner wall corresponding to the inclined transition surface.

* * * * *